US011027297B2

(12) United States Patent
Pouliaude

(10) Patent No.: US 11,027,297 B2
(45) Date of Patent: Jun. 8, 2021

(54) FLUID PRODUCT DISPENSING AND APPLICATION ASSEMBLY

(71) Applicant: APTAR FRANCE SAS, Le Neubourg (FR)

(72) Inventor: Florent Pouliaude, Fouqueville (FR)

(73) Assignee: APTAR FRANCE SAS, Le Neubourg (FR)

( * ) Notice: Subject to any disclaimer, the term of this patent is extended or adjusted under 35 U.S.C. 154(b) by 0 days.

(21) Appl. No.: 16/312,658

(22) PCT Filed: Jun. 23, 2017

(86) PCT No.: PCT/FR2017/051680

§ 371 (c)(1),
(2) Date: Dec. 21, 2018

(87) PCT Pub. No.: WO2018/002490

PCT Pub. Date: Jan. 4, 2018

(65) Prior Publication Data

US 2019/0321839 A1 Oct. 24, 2019

(30) Foreign Application Priority Data

Jun. 27, 2016 (FR) ..... 1655984

(51) Int. Cl.
*B05B 11/00* (2006.01)

(52) U.S. Cl.
CPC ..... *B05B 11/0054* (2013.01); *B05B 11/0008* (2013.01); *B05B 11/00416* (2018.08); *B05B 11/3032* (2013.01); *B05B 11/3045* (2013.01)

(58) Field of Classification Search
CPC ..... B05B 11/0054; B05B 11/00416; B05B 11/0008; B05B 11/3032; B05B 11/3045
(Continued)

(56) References Cited

U.S. PATENT DOCUMENTS 2,642,607 A * 6/1953 Bozzalla ..... A45D 34/042 401/150
2,715,236 A * 8/1955 Tereno ..... B05B 11/3032 401/151

(Continued)

FOREIGN PATENT DOCUMENTS

WO 2015/107305 A1 7/2015
WO 2015/107306 A1 7/2015

OTHER PUBLICATIONS

International Search Report for PCT/FR2017/051680 dated, Nov. 2, 2017 (PCT/ISA/210).

(Continued)

*Primary Examiner* — Michael J. Melaragno
(74) *Attorney, Agent, or Firm* — Sughrue Mion, PLLC

(57) ABSTRACT

A fluid dispenser comprising a dispenser member (1), such as a pump, a dispenser head (14), such as a fluid applicator, and a fluid reservoir (2) that is connected in leaktight and removable manner to the dispenser member (1), the fluid dispenser being characterized in that the sealing between the dispenser member (1) and the fluid reservoir (2) is obtained by coaxially sliding leaktight radial contact that is interrupted when the fluid reservoir (2) is disconnected from the dispenser member (1), such that the fluid reservoir (2) is connected in leaktight manner to the dispenser member (1) over a determined axial height range.

18 Claims, 4 Drawing Sheets

(58) Field of Classification Search
USPC ..... 222/207
See application file for complete search history.

(56) References Cited

U.S. PATENT DOCUMENTS 4,874,117 A * 10/1989 Kay ..... A45D 34/042 222/487
5,306,125 A 4/1994 Weag
5,346,324 A 9/1994 Kuo
7,306,123 B2 * 12/2007 Masuda ..... B05B 11/0029 222/386
7,306,124 B2 * 12/2007 Masuda ..... B05B 11/0029 222/386
8,007,193 B2 * 8/2011 Py ..... A45D 34/04 401/188 R
8,132,695 B2 * 3/2012 Py ..... B65D 47/18 222/207
8,690,468 B2 * 4/2014 Py ..... A45D 34/04 401/188 R
9,277,798 B2 * 3/2016 Moreau ..... A45D 34/04
9,629,438 B2 * 4/2017 Bruder ..... A45D 34/04
9,676,540 B2 * 6/2017 Py ..... A45D 34/04
10,194,729 B2 * 2/2019 Duquet ..... A45D 34/00
2006/0065677 A1 * 3/2006 Py ..... A45D 34/04 222/383.1
2007/0131719 A1 * 6/2007 Masuda ..... B05B 11/0029 222/256
2008/0296320 A1 * 12/2008 Kang ..... A45D 34/042 401/156
2010/0178097 A1 * 7/2010 Py ..... A45D 34/04 401/188 R
2011/0284579 A1 * 11/2011 Pardes ..... A61F 9/0008 222/207
2012/0219348 A1 * 8/2012 Py ..... A45D 34/04 401/151
2013/0037574 A1 * 2/2013 Py ..... B65D 47/18 222/207
2013/0218066 A1 * 8/2013 Duquet ..... A61N 5/0616 604/20
2014/0124541 A1 * 5/2014 Mathiez ..... A45D 34/04 222/207
2014/0296772 A1 * 10/2014 Duquet ..... A61N 5/0616 604/20
2014/0299632 A1 * 10/2014 Py ..... A45D 34/04 222/213
2014/0371690 A1 12/2014 Sprada et al.
2014/0374510 A1 * 12/2014 Krauss ..... B05B 11/02 239/487
2015/0086259 A1 * 3/2015 Moreau ..... A45D 34/04 401/266
2016/0184861 A1 * 6/2016 Daviot ..... A45D 34/04 401/143
2016/0263314 A1 * 9/2016 Pardes ..... A61F 9/0008
2016/0346798 A1 12/2016 Decottignies
2016/0346799 A1 12/2016 Muller
2017/0055672 A1 * 3/2017 Duquet ..... A45D 34/00
2017/0231379 A1 * 8/2017 Wu ..... A46B 11/002 401/282
2017/0297050 A1 * 10/2017 Sumiyoshi ..... A45D 34/04
2017/0326578 A1 * 11/2017 Kang ..... B65D 77/04
2017/0341102 A1 * 11/2017 Kang ..... B05C 1/06
2017/0341848 A1 * 11/2017 Py ..... A45D 34/04
2018/0020807 A1 * 1/2018 Villarreal ..... A45D 34/042 401/183
2019/0116960 A1 * 4/2019 Chen ..... B05B 11/0035
2019/0307228 A1 * 10/2019 Baumann ..... A45D 34/041

OTHER PUBLICATIONS

International Preliminary Report on Patentability dated Sep. 25, 2018 issued by the European Patent Office in PCT/FR2017/051680.

* cited by examiner

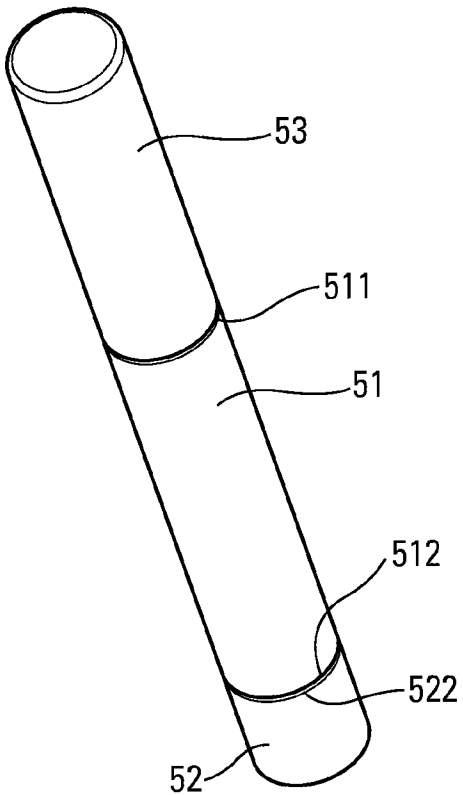
Fig. 3
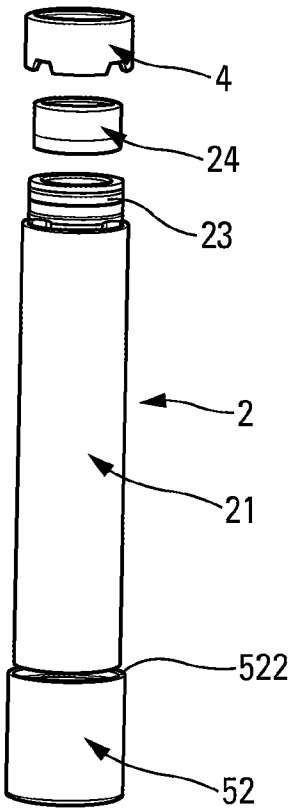
Fig. 2
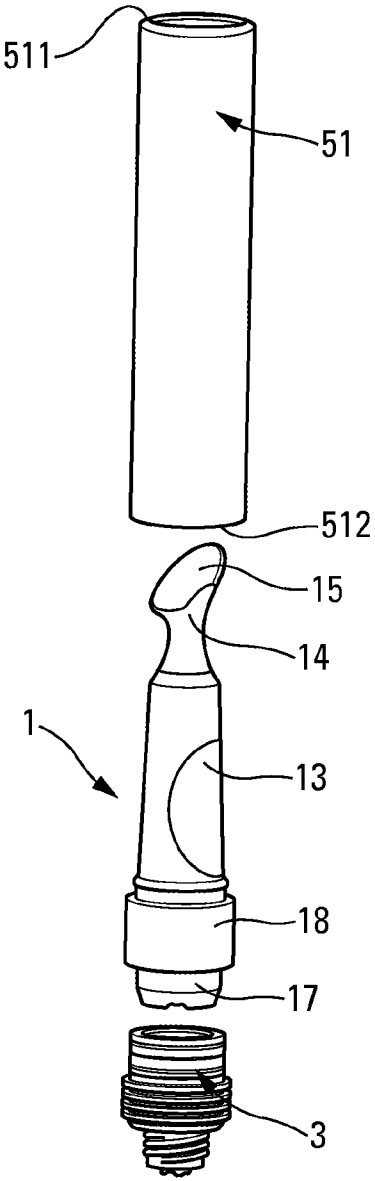
Fig. 1
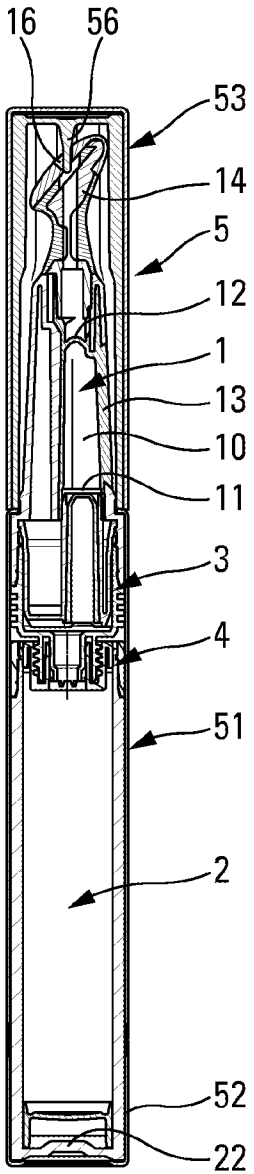

FLUID PRODUCT DISPENSING AND APPLICATION ASSEMBLY

CROSS REFERENCE TO RELATED APPLICATIONS

This application is a National Stage of International Application No. PCT/FR2017/051680 filed Jun. 23, 2017, claiming priority based on French Patent Application No. 1655984, filed Jun. 27, 2016.

The present invention relates to a fluid dispenser comprising a dispenser member, such as a pump, a dispenser head, such as a fluid applicator, and a fluid reservoir that is connected in leaktight and removable manner to the dispenser member. Thus, the reservoir, once empty, can be removed from the dispenser member so as to be replaced by a full reservoir of the same kind or of a different kind. The advantageous fields of application of the present invention are the fields of cosmetics, perfumery, and pharmacy.

In conventional manner, the fluid reservoir of a conventional dispenser is connected to the dispenser member by mechanical means (screw-fastening, snap-fastening, etc.) which makes it possible to compress a neck gasket between them. Sealing is thus provided by axial compression. As a result, the particular positioning of the reservoir relative to the dispenser member is determined by the thickness of the neck gasket, once compressed. This mutual positioning is also influenced by the manufacturing tolerances of the reservoir and of the dispenser member. In any event, sealing is obtained only when the neck gasket is compressed sufficiently. As a result, it is impossible to guarantee that the reservoir, and in particular its bottom wall, is accurately positioned relative to the dispenser member.

An object of the invention is to remedy the above-mentioned drawback of the prior art by defining a fluid dispenser in which the positioning of the fluid reservoir relative to the dispenser member is not dependent on the compression of a neck gasket.

To do this the present invention proposes that the sealing between the dispenser member and the fluid reservoir is obtained by coaxially sliding leaktight radial contact that is interrupted when the fluid reservoir is disconnected from the dispenser member, such that the fluid reservoir is connected in leaktight manner to the dispenser member over a determined axial height range. Thus, the dispenser of the invention does not involve flattening a neck gasket axially, by providing radial sealing that is provided, not only at a particular axial position, but also over an axial height range, as a result of the sealing being dynamic sealing obtained while sliding coaxially. In this way, sealing is guaranteed over the entire axial height range, regardless of the particular positioning of the reservoir relative to the dispenser member. In other words, the reservoir is now fastened mechanically on the dispenser member in a manner that is totally independent of the sealing between the reservoir and the dispenser member. By way of example, it is possible to provide a screw-fastened connection with radial sealing that is provided over the entire axial height of the screw-fastening.

Furthermore, the dispenser member further comprises an outer covering element that is open at its bottom end for inserting the fluid reservoir that is provided with a stopper element that comes into abutting contact with the bottom end of the outer cover so as to form a continuous outer cover. Thus, the final position of the reservoir relative to the dispenser member is determined by the abutting contact between the outer cover and the stopper element, without any concern about the sealing between the reservoir and the dispenser member that is provided in any event by the coaxially sliding leaktight radial contact.

In an advantageous embodiment, the dispenser member includes an inlet tube, the inside of which forms an inlet duct and the outside of which forms an annular bearing surface that is in leaktight sliding contact in a slide cylinder that is secured to the fluid reservoir, so as to define between them said coaxially sliding leaktight radial contact. The leaktight contact is provided while the annular bearing surface is in contact with the slide cylinder over the determined coaxial height range. According to an advantageous additional characteristic, the slide cylinder is initially closed by a closure membrane that is pierced by the inlet tube.

In an embodiment, the fluid reservoir may be connected to the dispenser member by screw-fastening. Naturally, other forms of connection could be envisaged without going beyond the ambit of the invention.

In a practical embodiment, the dispenser member may include a connection ring that forms the inlet tube and an external thread, the fluid reservoir including a connection ferrule that forms the slide cylinder and an internal thread for coming into engagement with the external thread of the connection ring. Advantageously, the end-of-screw-fastening abutment is defined by the abutting contact between the outer covering element and the stopper element, while the coaxially sliding leaktight contact is already established. In a practical aspect, the dispenser member may be held in place in the outer covering element by the connection ring that is advantageously adhesively-bonded in the outer covering element.

According to another advantageous characteristic of the invention, the dispenser member projects out from the outer covering element and includes a pusher, a removable protective cap advantageously being provided so as to cover the dispenser head and the pusher.

In another advantageous practical aspect, the fluid reservoir comprises a reservoir body, advantageously provided with a follower piston, the connection ferrule and the stopper element being mounted on the reservoir body.

The spirit of the invention resides in creating axially sliding leaktight radial contact between the reservoir and the dispenser member so as to decouple sealing from the relative position between the reservoir and the dispenser member. It is thus possible to determine the particular positioning of the reservoir relative to the abutting contact between two outer covering parts. The coaxially sliding radial sealing may be provided by means of a connection ring that is secured to the dispenser member and by a connection ferrule that is secured to the fluid reservoir. In other words, the radial sealing may be obtained merely by adding two additional parts to a conventional dispenser.

The invention is described below in greater detail with reference to the accompanying drawings, which show an embodiment of the invention by way of non-limiting example.

In the figures:

FIG. 1 is a vertical section view through a fluid dispenser of the invention;

FIG. 2 is an exploded perspective view of the FIG. 1 dispenser;

FIG. 3 is a perspective view of the dispenser in FIGS. 1 and 2, in its assembled state;

Figure 6A:
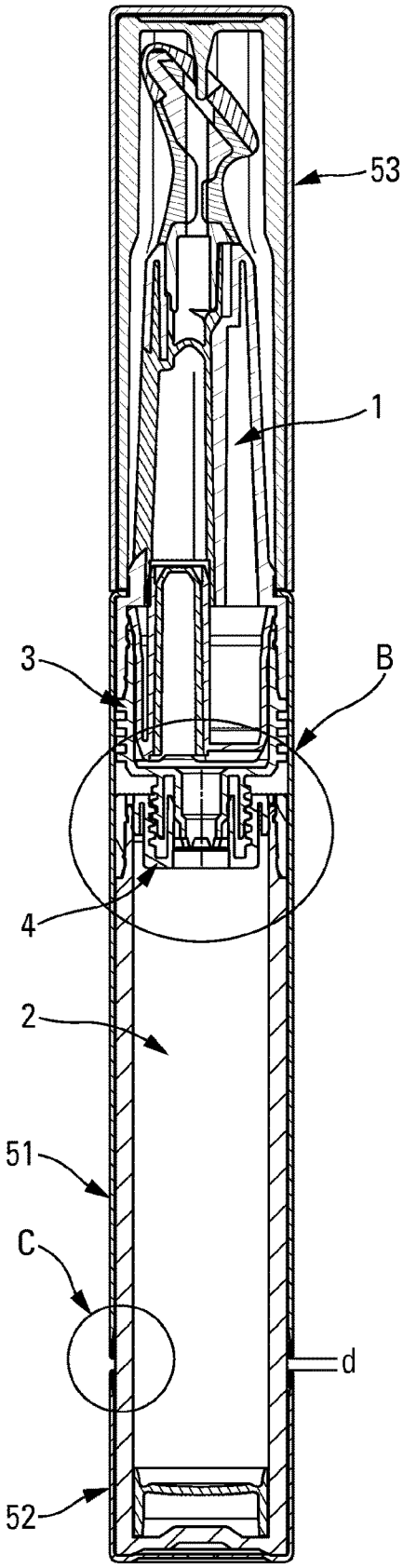
Figure 6B:
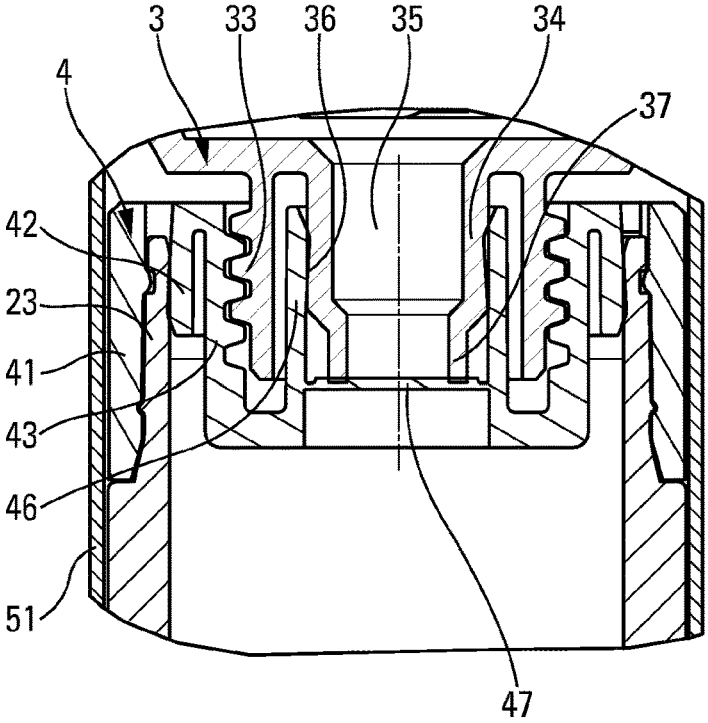

FIG. 6*a* is a view similar to the view in FIG. 1 while the reservoir is being connected;

FIG. 6*b* is a view on a much larger scale showing a detail B of FIG. 6*a;*

Figure 6C:
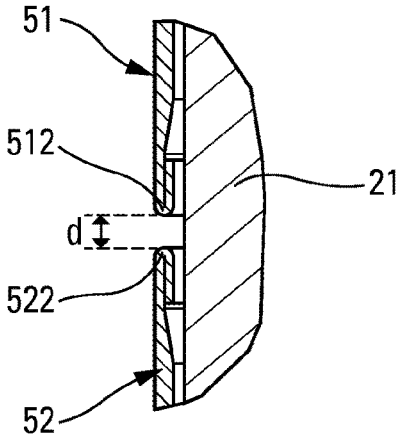

FIG. 6*c* is a view on a much larger scale showing a detail C of FIG. 6*a;*

Figure 7A:
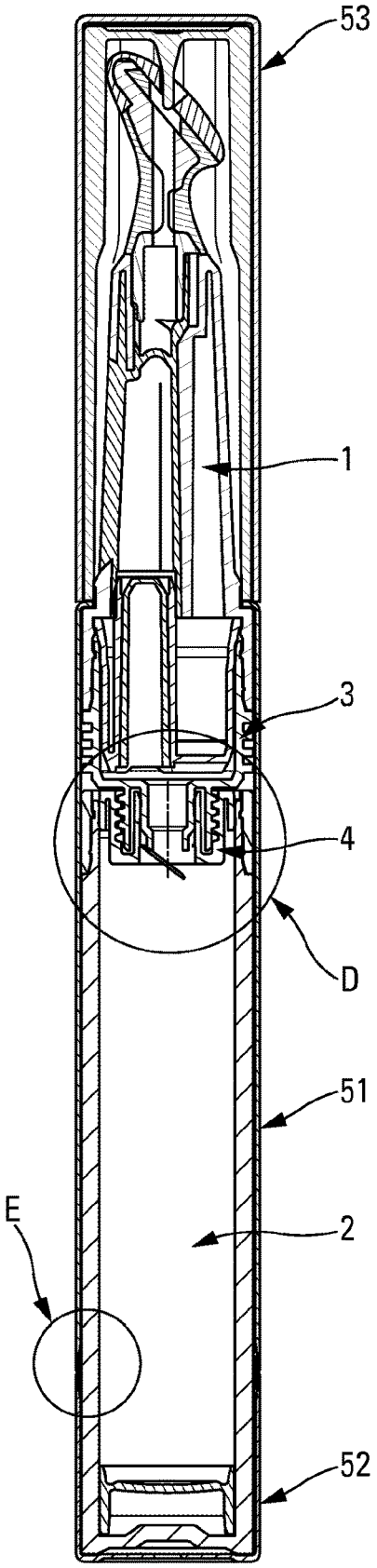
Figure 7B:
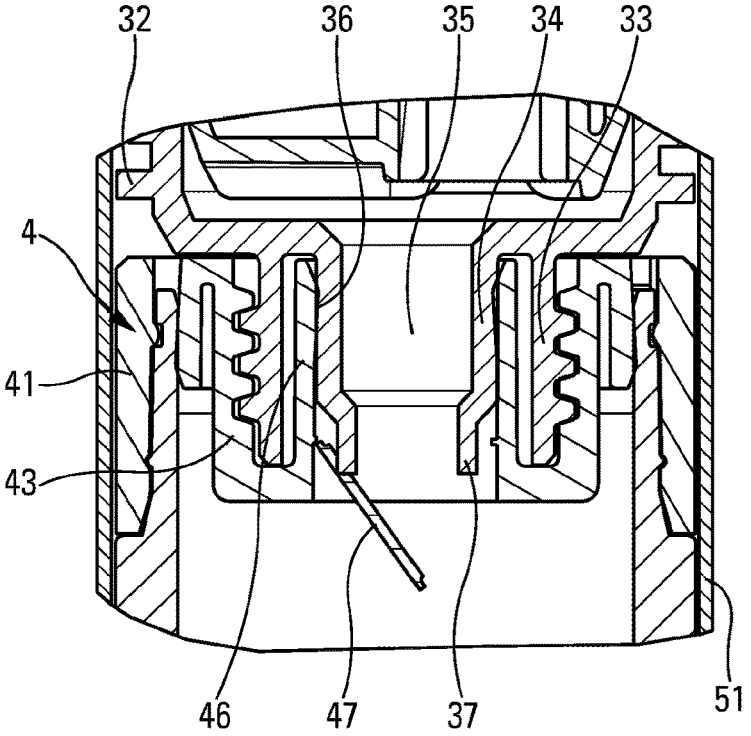
Figure 7C:
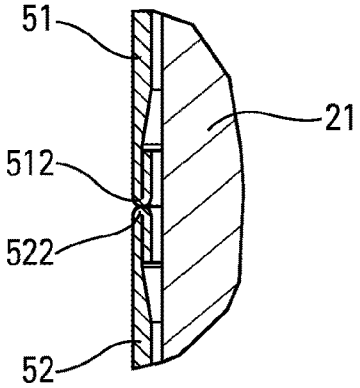

FIG. 7*a* is a view similar to the view in FIG. 6*a*, with the reservoir in its final position;

FIG. 7*b* is a view on a much larger scale showing a detail D of FIG. 7*a*; and FIG. 7*c* is a view on a much larger scale showing a detail E of FIG. 7*a*.

In entirely general manner, the fluid dispenser of the present invention comprises a dispenser member 1 that is associated in leaktight and removable manner with a fluid reservoir 2. The dispenser member may be of any kind, e.g. it may incorporate a pump, a valve, an applicator head, etc. The main function of the dispenser member is to convey fluid from the fluid reservoir 2 to a dispenser orifice from where the user can recover the fluid. The fluid dispensed at the dispenser orifice may present the form of a spray, a dab, a drop, etc. As described below, the dispenser member may include an applicator for applying and spreading the fluid on an application surface, such as the skin, the nails, the hair etc.

Reference is made below to FIGS. 1, 2, and 3 in order to describe in entirely general manner the structure of a fluid dispenser of the invention. In this embodiment, the dispenser member 1 incorporates a pump with a pump chamber 10 that is provided at its inlet with an inlet valve member 11 and at its outlet with an outlet valve member 12. The pump chamber 10 is provided with a pusher 13 in the form of a laterally-actuated wall on which the user can press so as to reduce the volume of the chamber 10. Thus, the fluid contained in the chamber 10 is put under pressure in such a manner as to close the inlet valve member 11 and open the outlet valve member 12. The fluid is thus forced towards the applicator head 14, advantageously provided with an applicator pad 15 having a dispenser orifice 16 passing therethrough. At its opposite end, the dispenser member 1 includes a skirt 18 inside which an insert 17 is received that supports the inlet valve member 11. This can be seen more particularly in FIG. 5.

In the invention, the dispenser member 1 is provided with a connection ring 3 that includes a collar 31 that is engaged around the insert 17 inside the skirt 18. The ring 3 also forms one or more fastener ribs 32, having a function that is explained below. The ring 3 also forms an external thread 33 inside which an inlet tube 34 extends. More precisely, the inside of the inlet tube 34 forms an inlet duct 35 that communicates directly with the inlet valve 11 through the insert 17. The outside of the tube 34 forms an annular bearing surface 36 that is advantageously cylindrical, or even slightly frustoconical. At its bottom end, the tube 34 forms one or more perforator profiles 37.

Figure 4:
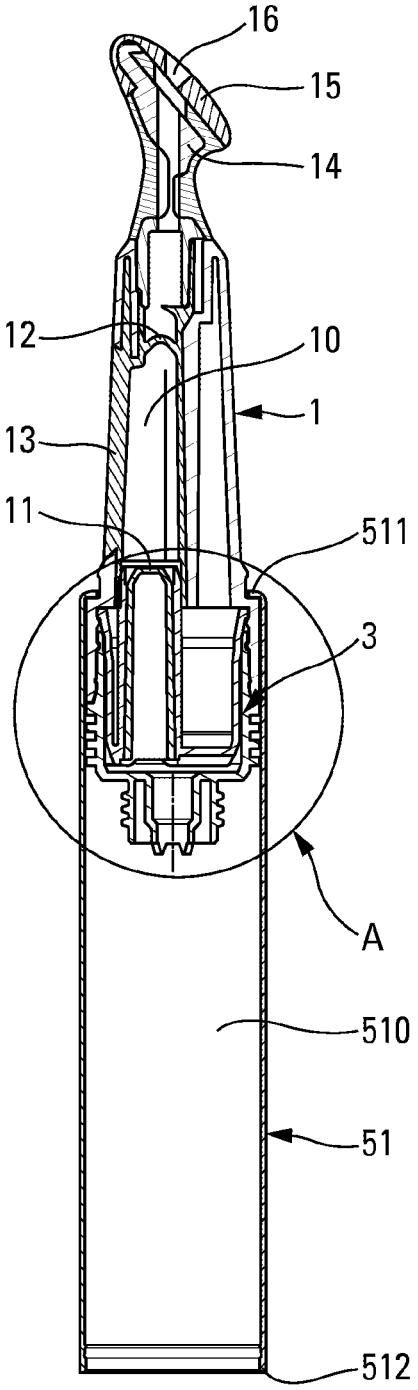
FIG. 4 is a view similar to the view in FIG. 1 with the reservoir removed.
Figure 5:
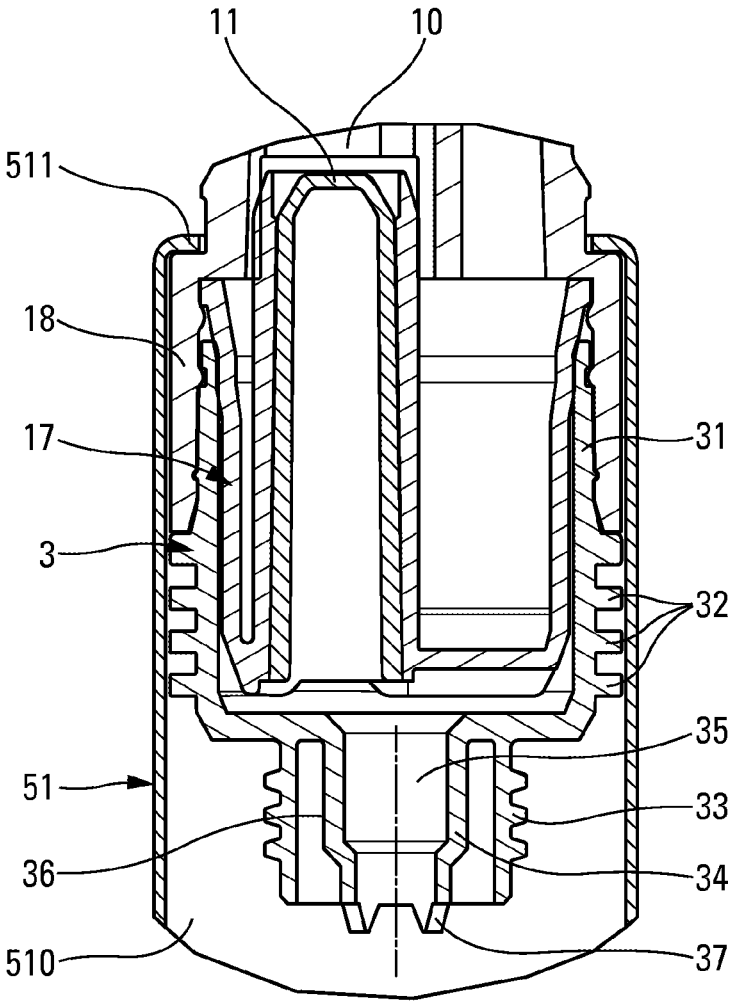
FIG. 5 is a view on a much larger scale showing a detail A of FIG. 4.

The dispenser member 1 is also provided with an outer covering element 51 that is of substantially tubular shape. The covering element 51 forms an inwardly-directed shoulder 511 at its top end, and a bottom end 512 that is wide open so as to enable the dispenser member 11 to pass therethrough during assembly. As can be seen in FIG. 5, the inwardly-directed shoulder 511 comes into abutment against the top edge of the skirt 18. In addition, the connection ring 3 may be sealed inside the covering element 51, e.g. by means of an adhesive deposited on the fastener ribs 32. In this way, the dispenser member 1 is fastened in stable and permanent manner inside the covering element 51. As can be seen in FIG. 4, the major fraction of the dispenser member 1 projects upwards out from the covering element 51, which covering element is filled in part only by the dispenser member, and in particular by the connection ring 3. Specifically, the pusher 13 and the applicator head 14 are arranged above the inwardly-directed shoulder 511. As can be seen in FIG. 1, a protective cap 53 comes to cover, in removable manner, the fraction of the dispenser member 1 that projects out from the covering element 51. Advantageously, the protective cap 53 forms a closure pin 56 that penetrates into and closes the dispenser orifice 16 in leaktight manner. Advantageously, the bottom edge of the protective cap 53 comes into abutting and continuous contact with the covering element 51 at the inwardly-directed shoulder 511. Advantageously, the diameter of the cap 53 is strictly equal to the diameter of the covering element 51, so that they are only visually defined by a nearly invisible line, as shown in FIG. 3.

The fluid reservoir 2 comprises a reservoir body 21 that is advantageously provided with a bottom wall 22 and that forms a neck 23 that is provided with one or more fastener profiles. The inside of the reservoir body 21 may receive a follower piston 24 that, in its initial position, is arranged in the proximity of the bottom wall 22, when the reservoir is filled with fluid.

In the invention, the reservoir 2 is provided with a connection ferrule 4 that is mounted in stationary manner on the neck 23. With reference to FIG. 6*b*, it can be seen that the connection ferrule 4 includes a fastener flange 41 that comes into engagement with the neck 23, e.g. by snap-fastening. The ferrule 4 forms a self-sealing lip 42 that is in leaktight contact with the inside wall of the neck 23. In addition, the ferrule 4 includes an internal thread 43 for co-operating with the external thread 33 of the connection ring 3. The connection ferrule 4 also forms a slide cylinder 46 inside which the tube 34 is engaged. More precisely, the annular bearing surface 36 is for coming into leaktight sliding contact inside the slide cylinder 46 of the ferrule 4, as can be seen clearly in FIG. 6*b*. Advantageously, the ferrule 4 also forms a closure membrane 47 that is formed inside the slide cylinder 46.

The fluid reservoir is also provided with a stopper element 52 that is situated at the bottom end of the reservoir. More precisely, the bottom end of the reservoir body 21 may merely be force-fitted into the stopper element 52 that forms a top edge 522. The top edge 522 is for coming into abutting and continuous contact with the bottom end 512 of the covering element 51 for covering the dispenser member 1, so as to co-operate with each other to form a continuous cover. Preferably, the stopper element 52 presents a diameter that is identical to the diameter of the covering element 51, so that they are separated only by a nearly invisible line, as shown in FIG. 3.

The stopper element 52 also serves as a grip member for the fluid reservoir 2, so as to be able to insert it into the covering element 51 through its open bottom end 512. A user thus takes hold of the reservoir 2 by the stopper element 52 and engages it inside the covering element 51 until the ferrule 4 comes into contact with the ring 3. The tube 34 immediately engages inside the slide cylinder 46, and the internal threads 43 and the external threads 33 come into engagement. The user may thus impart a turning movement on the stopper element 52, so as to screw-fasten the ferrule 4 on the ring 3. During the screw-fastening operation, the ferrule 4 moves axially towards the ring 3. In the invention, during the screw-fastening operation, the tube 34 slides in leaktight manner inside the slide cylinder 46, thereby creating coaxially sliding leaktight radial contact. The user can continue to screw-fasten the reservoir into the covering element 51 until the user encounters a small amount of hardness or resistance as a result of the tube coming into abutment against the membrane 47. This configuration is shown in FIGS. 6*a*, 6*b*, and 6*c*. In particular, in FIGS. 6*a* and 6*c*, it can be seen that the covering element 51 is still separated from the stopper element 52 by a small gap d. The user can thus impart additional torque on the stopper element 52 so as to continue screw-fastening, enabling the perforator profile 37 to break the membrane 47. This final configuration is shown in FIGS. 7*a*, 7*b*, and 7*c*. In particular, it can be seen that the membrane 47 is pushed into its open position by the perforator profiles 37, and that the thread 33 is fully screw-tightened in the thread 43. In addition, in FIG. 7*c*, it can be seen that the bottom end 512 is in intimate and continuous abutting contact with the top edge 522 of the stopper element 52.

It should be observed that the abutting contact between the covering element 51 and the stopper element 52 is made possible as a result of the sealing between the ferrule 4 and the ring 3 being provided by means of coaxially sliding leaktight radial contact, and not by the axial flattening of a neck gasket. From another point of view, it could be considered that the sliding radial contact over a determined axial height range makes it possible to position the reservoir axially relative to the dispenser member 1 with a significant amount of axial latitude, thereby making it possible in particular to be able to determine the position of the reservoir relative to the dispenser member as a function of other criteria, e.g. the cover, formed by the covering element 51 and the stopper element 52. However, in the ambit of the present invention, it should be considered that the sliding radial contact may be used in other applications that require the reservoir to be positioned relative to the dispenser member.

The present invention departs from the conventional neck gasket that is axially flattened, by providing sliding radial contact that thus makes it possible to position the reservoir relative to the dispenser member over a range of axial heights that is relatively large compared to axially flattening a neck gasket.

The invention claimed is:

1. A fluid dispenser comprising a dispenser member (1), a dispenser head (14), and a fluid reservoir (2) that is connected in leaktight and removable manner to the dispenser member (1), the sealing between the dispenser member (1) and the fluid reservoir (2) being obtained by coaxially sliding leaktight radial contact that is interrupted when the fluid reservoir (2) is disconnected from the dispenser member (1), such that the fluid reservoir (2) is connected in leaktight manner to the dispenser member (1) over a determined axial height range;

wherein the dispenser member (1) further comprises an outer covering element (51) that is open at its bottom end (512) for inserting the fluid reservoir (2) that is provided with a stopper element (52) secured to the fluid reservoir and that comes into abutting contact with the bottom end (512) of the outer cover (51) so as to form a continuous outer cover.

2. A dispenser according to claim 1, wherein the dispenser member (1) includes an inlet tube (34) the inside of which forms an inlet duct (35) and the outside of which forms an annular bearing surface (36) that is in leaktight sliding contact in a slide cylinder (46) that is secured to the fluid reservoir (2), so as to define between them said coaxially sliding leaktight radial contact.

3. A dispenser according to claim 2, wherein the slide cylinder (46) is initially closed by a closure membrane (47) that is pierced by the inlet tube (34).

4. A dispenser according to claim 1, wherein the fluid reservoir (2) is connected to the dispenser member (1) by screw-fastening.

5. A dispenser according to claim 2, wherein the dispenser member (1) includes a connection ring (3) that forms the inlet tube (34) and an external thread (33), the fluid reservoir (2) including a connection ferrule (4) that forms the slide cylinder (46) and an internal thread (43) for coming into engagement with the external thread (33) of the connection ring (3).

6. A dispenser according to claim 5, wherein the end-of-screw-fastening abutment is defined by the abutting contact between the outer covering element (51) and the stopper element (52), while the coaxially sliding leaktight contact is already established.

7. A dispenser according to claim 5, wherein the dispenser member (1) is held in place in the outer covering element (51) by the connection ring (3) that is advantageously adhesively-bonded in the outer covering element (51).

8. A dispenser according to claim 1, wherein the dispenser member (1) projects out from the outer covering element (51) and includes a pusher (13), a removable protective cap (53) advantageously being provided so as to cover the dispenser head (1) and the pusher (13).

9. A dispenser according to claim 5, wherein the fluid reservoir (2) comprises a reservoir body (21), advantageously provided with a follower piston (24), the connection ferrule (4) and the stopper element (52) being mounted on the reservoir body (21).

10. The dispenser according to claim 1, wherein the dispenser member is a pump.

11. The dispenser according to claim 1, wherein the dispenser head is a fluid applicator.

12. The dispenser according to claim 1, wherein the stopper element is fixed to the reservoir such that the reservoir is configured to be removed together with the stopper element by a user holding the reservoir by the stopper element.

13. The dispenser according to claim 1, wherein the dispenser member is configured to be is removed from the fluid reservoir and reconnected in a leaktight manner to a new fluid reservoir.

14. The dispenser according to claim 1, wherein the stopper element is secured to a bottom of the fluid reservoir through a force-fit connection.

15. The dispenser according to claim 1, wherein the stopper element is secured to the fluid reservoir so as to function as a grip for the fluid reservoir.

16. The dispenser according to claim 1, wherein the stopper element is secured to the fluid reservoir so that turning the stopper element imparts turning motion on the reservoir.

17. The dispenser according to claim 1, wherein the abutting contact with the bottom end results from the coaxially sliding leaktight radial contact between the reservoir and the dispenser member over the determined axial height range.

18. A fluid dispenser comprising a dispenser member, a dispenser head, and a fluid reservoir that is connected in leaktight and removable manner to the dispenser member, the sealing between the dispenser member and the fluid reservoir being obtained by coaxially sliding leaktight radial contact that is interrupted when the fluid reservoir is disconnected from the dispenser member, such that the fluid reservoir is connected in leaktight manner to the dispenser member over a determined axial height range;

wherein the dispenser member further comprises an outer covering element that is open at its bottom end for inserting the fluid reservoir that is provided with a stopper element secured to the fluid reservoir and that comes into abutting contact with the bottom end (512) of the outer cover so as to form a continuous outer cover;

wherein the dispenser member includes an inlet tube the inside of which forms an inlet duct and the outside of which forms an annular bearing surface that is in leaktight sliding contact in a slide cylinder that is secured to the fluid reservoir, so as to define between them said coaxially sliding leaktight radial contact; and wherein the dispenser member includes a connection ring that forms the inlet tube and an external thread, the fluid reservoir including a connection ferrule that forms the slide cylinder and an internal thread for coming into engagement with the external thread of the connection ring.

* * * * *